US008992401B2

(12) United States Patent
Bassi

(10) Patent No.: US 8,992,401 B2
(45) Date of Patent: Mar. 31, 2015

(54) AUTOMATIC MACHINE AND METHOD FOR MAKING CURVILINEAR PACKING BOXES

(75) Inventor: Gino Bassi, San Giovanni In Persiceto (IT)

(73) Assignee: Emmeci S.p.A., Milan (IT)

( * ) Notice: Subject to any disclaimer, the term of this patent is extended or adjusted under 35 U.S.C. 154(b) by 1062 days.

(21) Appl. No.: 13/003,165

(22) PCT Filed: Jul. 16, 2009

(86) PCT No.: PCT/IB2009/053101

§ 371 (c)(1),
(2), (4) Date: Jan. 7, 2011

(87) PCT Pub. No.: WO2010/010496

PCT Pub. Date: Jan. 28, 2010

(65) Prior Publication Data

US 2011/0111939 A1 May 12, 2011

(30) Foreign Application Priority Data

Jul. 23, 2008 (IT) ..... BO2008A0463

(51) Int. Cl.
*B31B 3/02* (2006.01)
*B31B 17/00* (2006.01)

(52) U.S. Cl.
CPC ..... *B31B 17/00* (2013.01); *B31B 2201/262* (2013.01); *B31B 2217/003* (2013.01); *B31B 2217/064* (2013.01); *B31B 2217/082* (2013.01)
USPC ..... 493/297

(58) Field of Classification Search
CPC ..... B31B 17/00; B31B 2201/262; B31B 2217/003; B31B 2217/064; B31B 2217/082; B31B 3/00; B31B 1/34; B31B 13/00; B31B 2201/2629; B31C 3/00; B65D 2543/00268; B65B 25/148; B65B 11/28; B65B 11/30; B65B 11/16; B65B 11/10; B65B 11/56; B65H 45/22; B29C 51/16; B29C 53/36
USPC ..... 493/52, 297, 388, 399, 295, 155, 306, 493/391, 112; 156/213, 443, 446, 476, 479, 156/480, 487, 563; 53/214, 234, 222, 170; 198/345
See application file for complete search history.

(56) References Cited

U.S. PATENT DOCUMENTS

| | | | | | |
|---|---|---|---|---|---|
| 940,541 | A | * | 11/1909 | MacDonald | 493/335 |
| 1,875,986 | A | * | 9/1932 | Bronander | 493/164 |
| 1,885,910 | A | * | 11/1932 | Gwinn et al. | 493/164 |
| 2,737,862 | A | * | 3/1956 | Thull | 493/112 |
| 3,126,798 | A | * | 3/1964 | Fairchild | 493/109 |
| 3,369,726 | A | * | 2/1968 | Wilcox | 229/5.5 |
| 3,579,958 | A | * | 5/1971 | Hentges et al. | 53/565 |
| 4,072,226 | A | * | 2/1978 | Richards et al. | 198/345.1 |

(Continued)

FOREIGN PATENT DOCUMENTS

| | | | |
|---|---|---|---|
| EP | 0011550 | A | 5/1980 |
| EP | 0038488 | A | 10/1981 |
| WO | 2008090455 | A2 | 7/2008 |

*Primary Examiner* — Thanh Truong
*Assistant Examiner* — Dianne Mitchell
(74) *Attorney, Agent, or Firm* — Pearne & Gordon LLP

(57) ABSTRACT

A machine for making covered paper or cardboard boxes which have a curvilinear outline comprises means for forming a curvilinear box (6) and a covering station (R) operating in conjunction with means for the linear feed of a pre-glued covering sheet (12), in such a way that the sheet (12) is connected to the outer wall of the box (6).

15 Claims, 12 Drawing Sheets

(56) References Cited

U.S. PATENT DOCUMENTS

| | | | | | |
|---|---|---|---|---|---|
| 4,127,059 | A * | 11/1978 | Richards | 493/109 |
| 4,292,102 | A * | 9/1981 | Bidegain | 156/213 |
| 4,302,275 | A * | 11/1981 | Burmeister et al. | 156/446 |
| 4,308,023 | A * | 12/1981 | Bidegain | 493/295 |
| 4,366,016 | A * | 12/1982 | Golden, Jr. | 156/218 |
| 4,976,675 | A * | 12/1990 | Bosi | 493/295 |
| 5,161,302 | A * | 11/1992 | Mueller | 29/773 |
| 5,214,988 | A * | 6/1993 | Quigley | 82/48 |
| 6,023,909 | A * | 2/2000 | Boldrini | 53/234 |
| 6,406,415 | B1 * | 6/2002 | Haggman | 493/105 |
| 6,735,924 | B2 * | 5/2004 | Graffin | 53/290 |
| 7,805,911 | B2 * | 10/2010 | Bassi | 53/206 |
| 8,517,903 | B2 * | 8/2013 | Bassi | 493/155 |
| 2007/0256394 | A1 * | 11/2007 | Bassi | 53/222 |
| 2009/0156380 | A1 * | 6/2009 | Calugi | 493/111 |
| 2010/0173763 | A1 | 7/2010 | Bassi | |

* cited by examiner

AUTOMATIC MACHINE AND METHOD FOR MAKING CURVILINEAR PACKING BOXES

TECHNICAL FIELD

The present invention relates to an automatic machine for making and covering paper or cardboard packing boxes which have a curvilinear outline.

BACKGROUND ART

Prior art devices for forming curvilinear boxes usually consist of machines which assemble a body which has a cylindrical wall with a separate bottom having the same outline and which is normally joined to the wall by gluing.

Covering the boxes consists of subsequent application of a layer of covering paper which gives the end product the desired outer finish.

However, prior art machines have several disadvantages in the automatic production of high quality covered boxes, that is to say, in which in the finished box the presence of separate parts, such as the base and the cylindrical wall cannot easily be seen or felt.

A second disadvantage is the fact that it is not possible to automatically and efficiently perform the entire processing of a covered curvilinear box, starting with assembly of the separate parts, the bottom and the wall, up to covering of the finished product.

DISCLOSURE OF THE INVENTION

A first aim of the present invention is to overcome the problem of automatic production of covered paper or cardboard boxes which have a curvilinear, preferably circular shape.

A second aim of the invention is to propose a machine and method for automatically making covered paper or cardboard curvilinear boxes with high productivity and at the same time able to make high quality boxes.

The technical purpose indicated and the aims specified are substantially achieved by a machine and method for making boxes comprising the technical features described in one or more of the claims herein.

BRIEF DESCRIPTION OF THE DRAWINGS

Further features and advantages of the present invention are more apparent in the detailed description below, with reference to a preferred, non-limiting, embodiment of the invention, illustrated in the accompanying drawings, in which.

DETAILED DESCRIPTION OF THE PREFERRED EMBODIMENTS OF THE INVENTION

With reference to the accompanying drawings, a machine is described for making curvilinear boxes 6, obtained starting with a curvilinear cylindrical wall 1 connected to a bottom or base 2.

It should be noticed that according to the present invention, the wall 1 may be made from pre-formed tubes, or may be formed in a line in a suitable operating station upstream of the machine.

Figure 11:
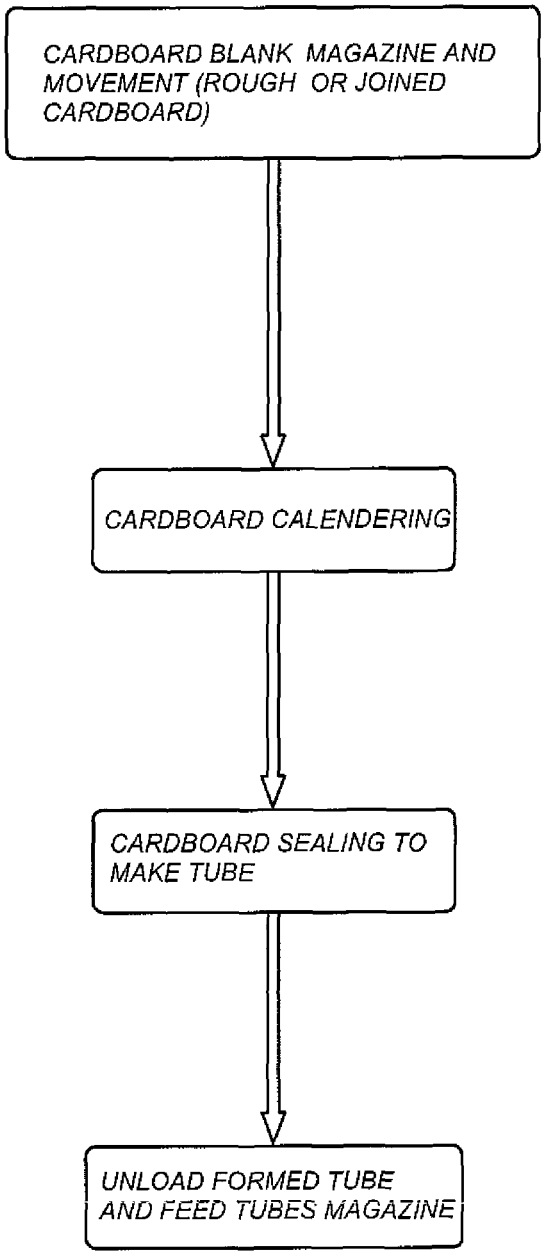
FIG. 11 shows a succession of steps for the in line production of tubes intended to constitute the wall of cylindrical boxes.

In the example in FIG. 11, a station for forming cylindrical tubes may have, one after another, a cardboard blank (rough or joined) magazine from which the cardboard, having dimensions equal to the length of the box to be formed, is picked up and moved to a calendering station in which the tube is formed by sealing the free ends of the cardboard.

Once the cylindrical tube has been formed, it is unloaded and fed to a finished tubes magazine.

Figure 1:
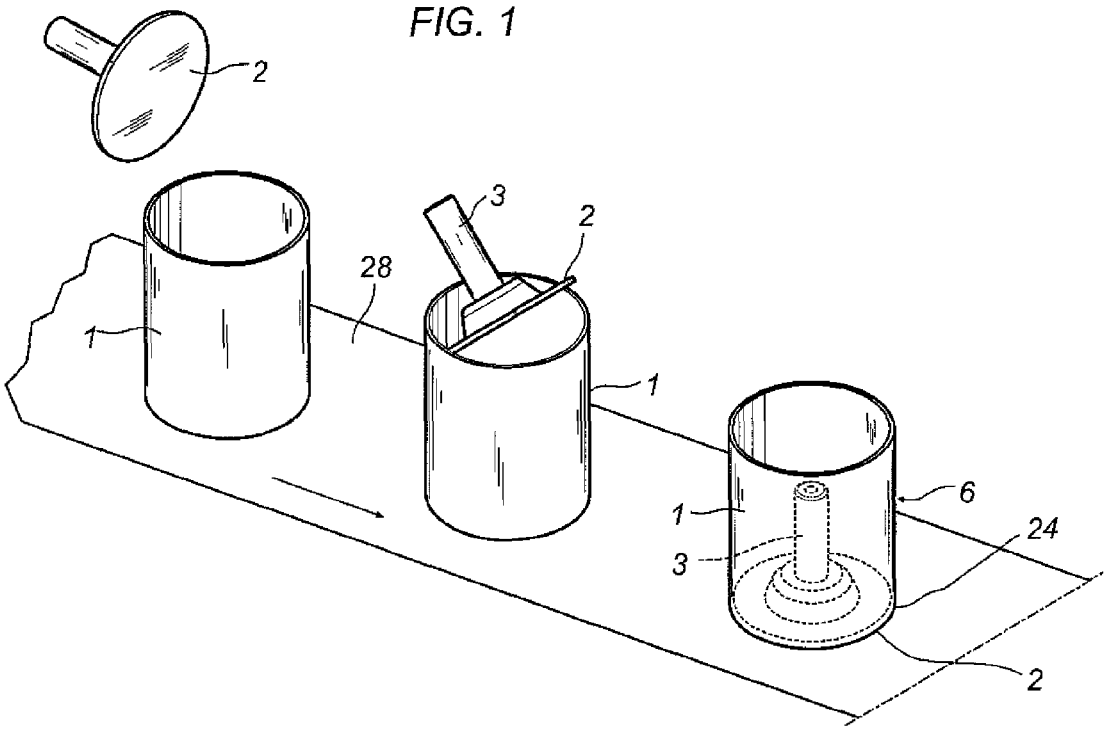
FIG. 1 is a schematic view of steps for assembling a curvilinear wall with a base.

Preferably, and with reference to FIG. 1, the box 6 has a circular outline, and is obtained by inserting the bottom 2 in a wall having a round cross-section 1 using a gripper element 3, for example of the suction cup type, until one end 24 of the wall is closed by mechanical interference.

Figure 2:
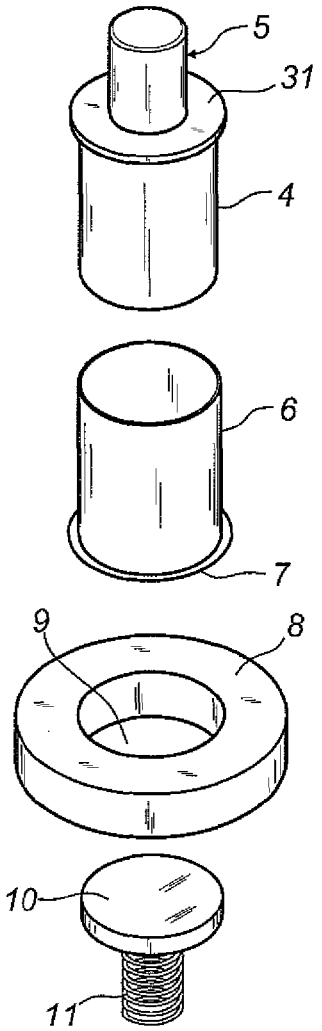
FIG. 2 is an exploded schematic view of devices in accordance with the invention for stably joining with a pre-glued disk of covering paper the base and the curvilinear wall of FIG. 1.
Figure 3:
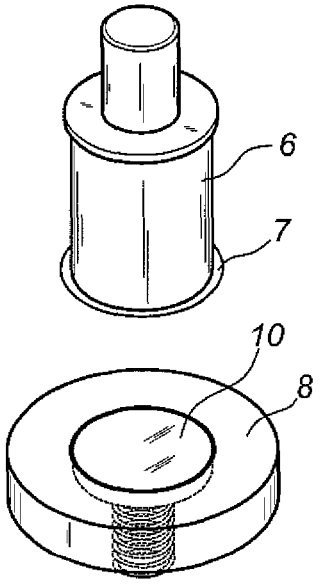
FIGS. 3 and 4 are schematic views of successive steps of the application of a pre-glued disk by the devices of FIG. 2.
Figure 4:
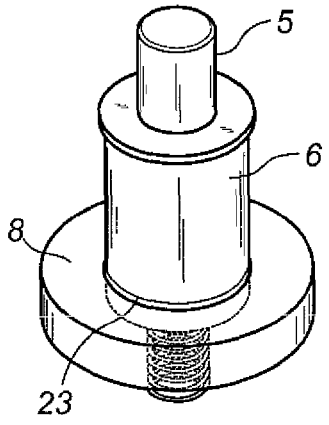

With reference to FIGS. 2-4, the bottom 2 and the wall 1 may be stably joined by applying a pre-glued disk 7 to the end 24 of the box.

Figure 9:
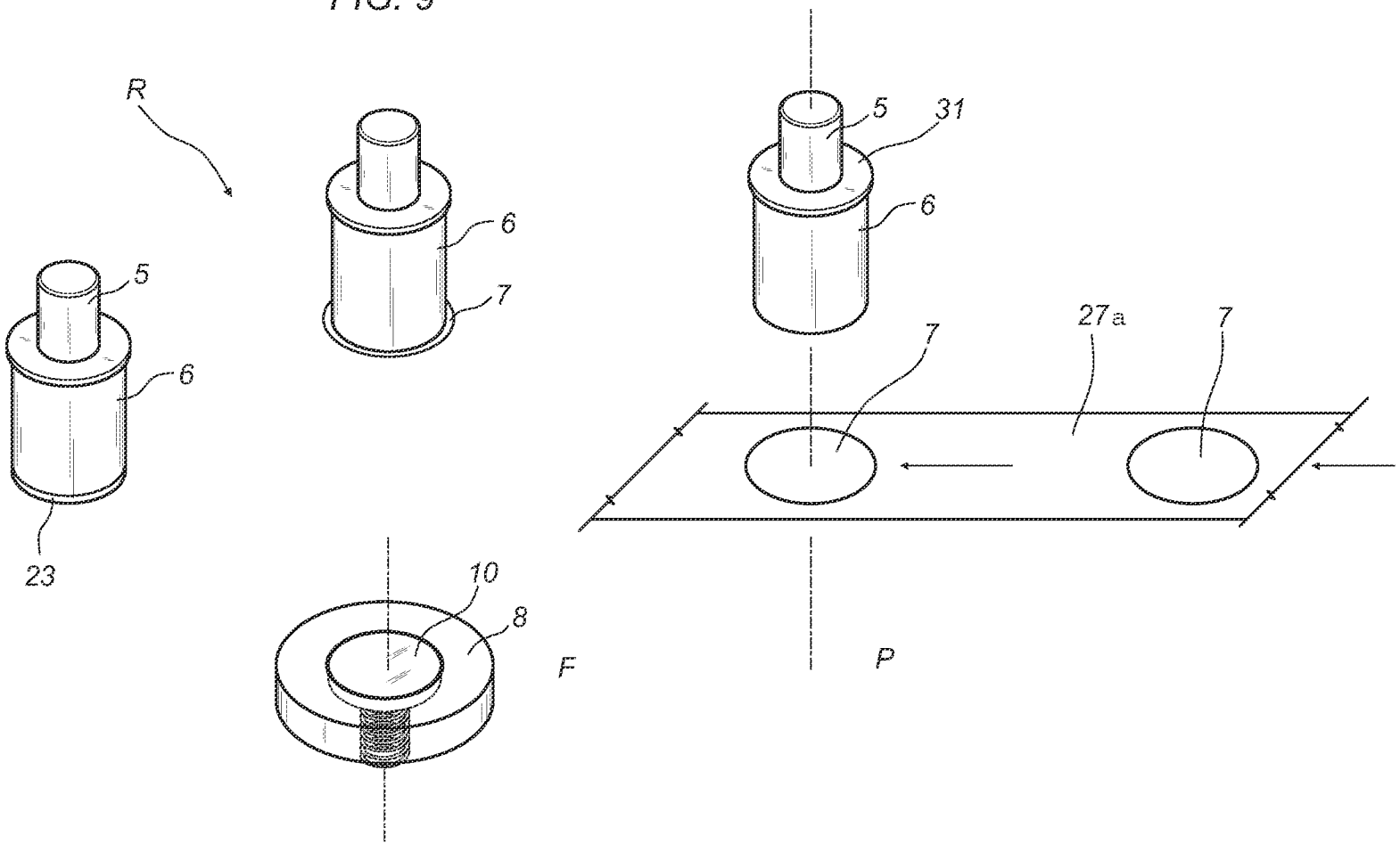
FIG. 9 is a schematic view of the step of transferring an assembled box to the aiming and forming stations.

Preferably, and with reference to FIG. 9, the disk 7 has radial dimensions slightly greater than the outer diameter of the box 6 and travels resting on a conveyor belt 27*a* to an aiming station P.

In the station P, the box 6 may be engaged by a gripper element 5 with vertical stroke, positioned above the pre-glued disk 7 and comprising a cylindrical body 4 which can be precisely inserted in the box 6 until contact is made with a flange 31, so as to place the box 6 centred on the disk 7 over the latter and glue it there.

In particular, the box is centred by devices which search for the position of the disk (of the known type in the sector), which having identified the position of the disk centre the box with precise vertical alignment.

Once centring is complete, the box 6 and the disk 7 are moved to a forming station F in which there is a toroidal supporting surface 8 having an opening 9 with the shape and dimensions corresponding precisely to the outer outline of the box 6.

On the opposite side to the opening 9, in the example described, there may also be a plate 10, if necessary mounted on springs 11, having dimensions such that it can be drawn near to the opening 9 in contact with the disk 7.

In operation, the box 6 with the glued disk 7 is lowered to the opening 9, and the plate 10 draws near to the non-adhesive side of the disk 7.

Continuing the box 6 stroke through the opening 9, the spring 11 yields, the bottom of the box passes through the opening 9 in a precise fashion, and the portion of the disk 7 extending beyond the opening 9 is pressed onto the stretch of wall 23 adjacent to the bottom, thus stably joining the bottom 2 and the wall 1 of the box 6.

FIGS. 5 to 9 schematically illustrate a covering station R in accordance with the invention, in which the box 6 is transferred, passing from a vertical orientation to a horizontal orientation, by tipping means able to engage the box exiting the forming station F and rotate it until it adopts a horizontal orientation, after which the box 6 is received by the covering station R, if necessary passing through an intermediate magazine for boxes 6 which are not yet laterally covered.

According to the invention, the station R is part of a carrousel unit 26 which rotates, driven by a drive unit 27 and comprises a plurality of operating stations S, at least one intended for a step of loading a formed box to be covered, and, after covering, for a finished box unloading step.

The stations S are not described in detail, as they are not themselves the subject matter of the invention.

In the example described, a box 6 already formed is being processed in a covering station R, and is already positioned on a spindle 19 mounted at the end of a carrousel 26 arm 25.

The dimensions of the spindle 19, which may be expanded on command, are such that it engages in the box 6 and can rotate about an axis 20 driven by a drive unit 14.

Figure 5:
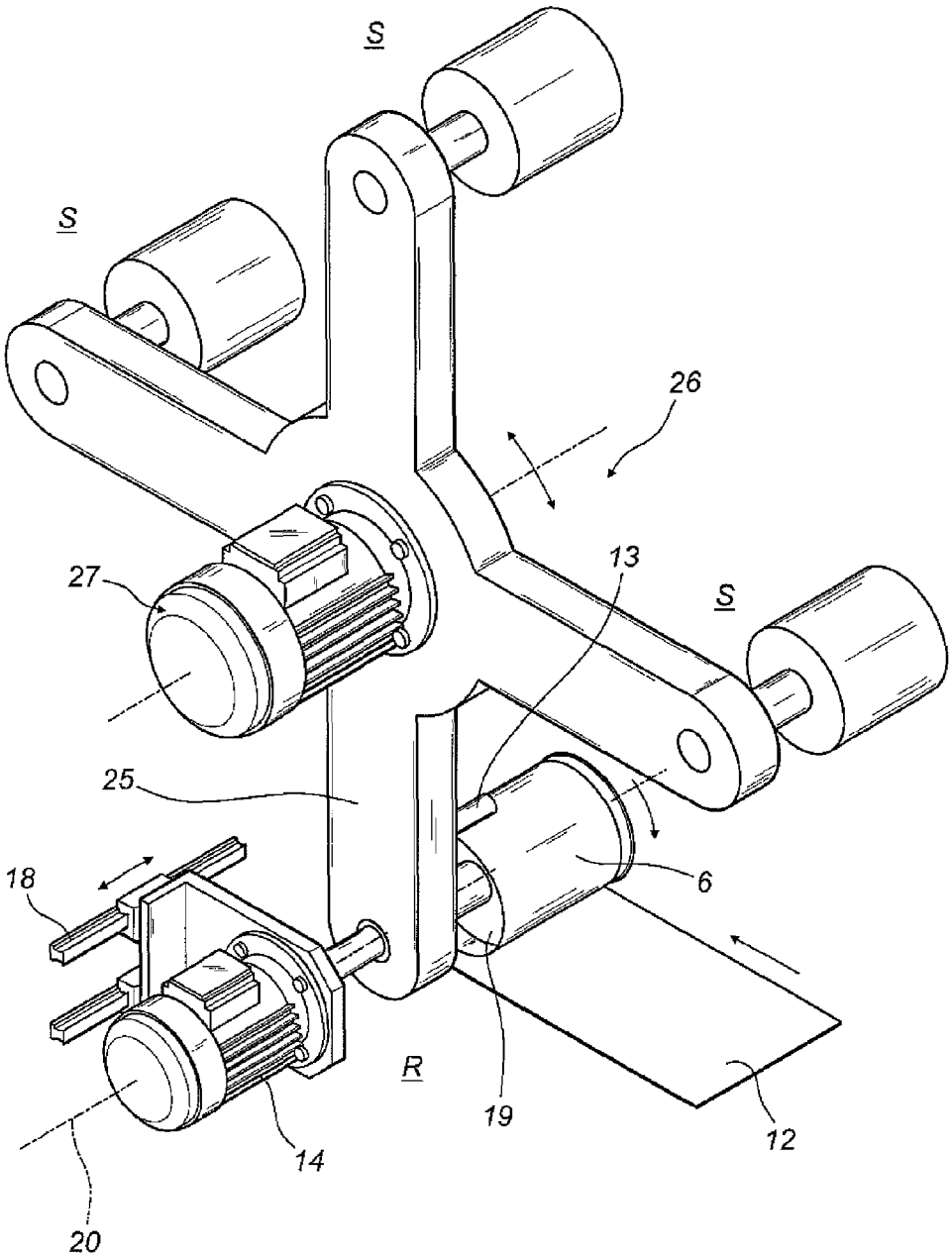
FIG. 5 illustrates a carrousel unit with a covering station in accordance with the invention.
Figure 6:
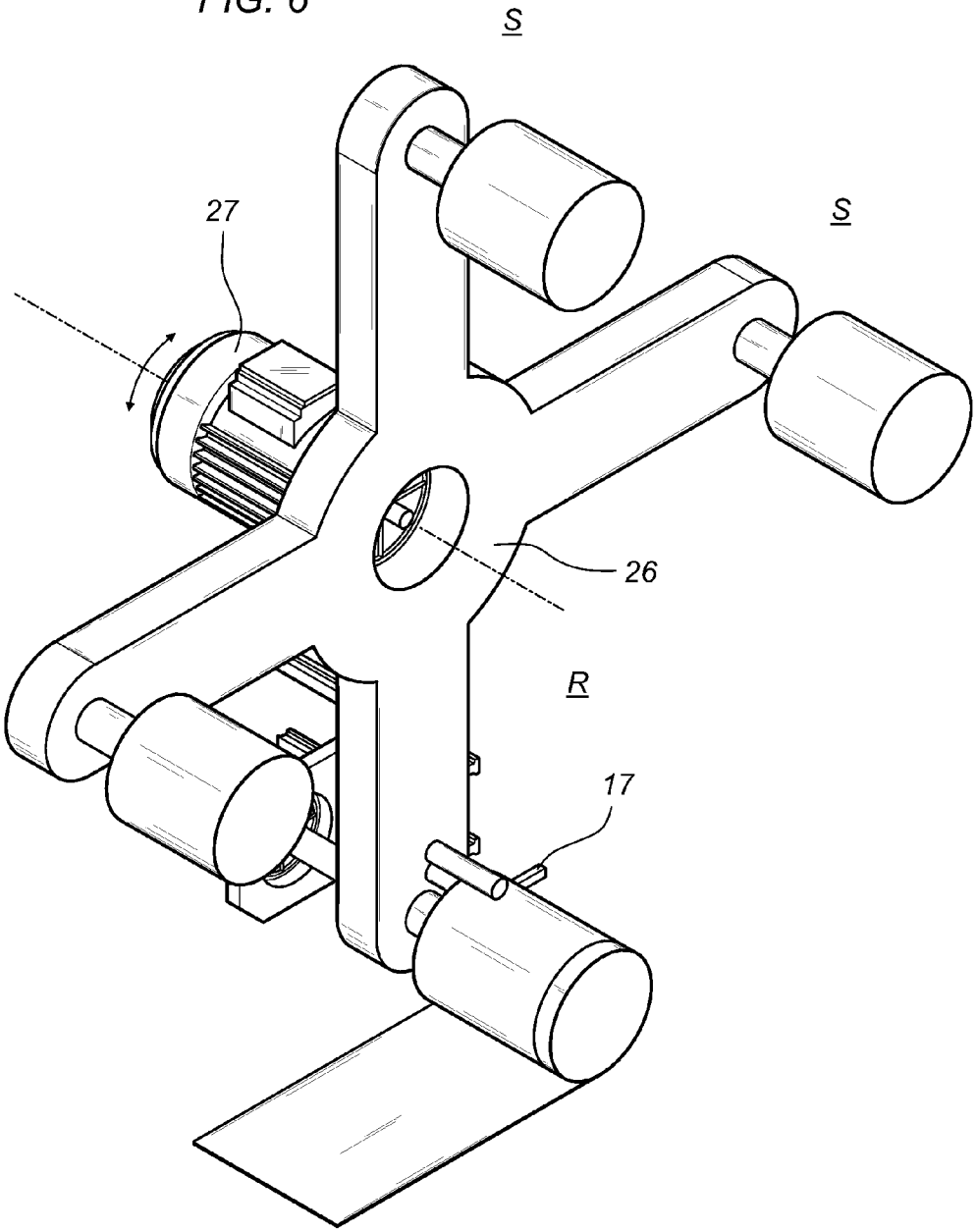
FIG. 6 shows a detail of the carrousel from FIG. 5 with a box at the covering step.

In the embodiment illustrated, the longitudinal motion of the motor 14 is guided by fixed prismatic guides 18, schematically illustrated in FIG. 5.

According to the invention, in the station R, the spindle 19 rotates the box along the axis 20 in such a way that it is synchronised with the arrival of a pre-glued covering sheet 12, fed transversally to the axis 20 until it makes contact with a box 6 generatrix along which covering takes place.

The box speed of rotation, and the sheet 12 linear feed speed are fixed so that the tip speed at the covering point coincides with the sheet 12 speed.

Alternatively, after a first sheet 12 gluing stretch on the box 6, covering may continue by dragging the sheet 12 in the absence of forced sheet feed.

The sheet 12 longitudinal extent and length are also such that it covers the entire outer wall 1 and leaves an edge 22 extending beyond it at the box 6 open end 21.

It should be noticed that, in other embodiments, the sheet 12 may be fed in the form of individual pre-cut sheets, or there may be a step of cutting a continuous sheet to size.

Figure 7:
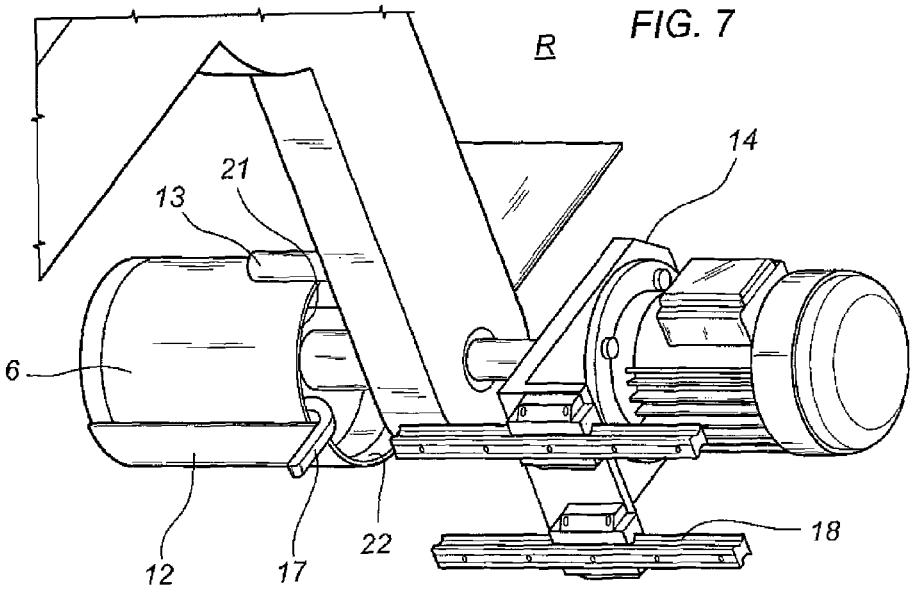
FIG. 7 shows another detail of the box covering step.
Figure 8:
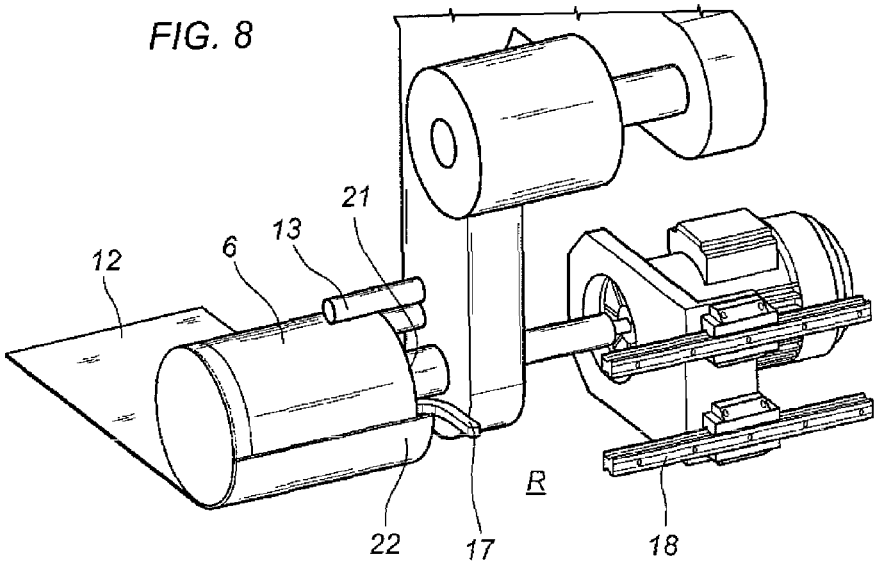
FIG. 8 shows yet another detail of the box covering step.

In particular with reference to FIGS. 7 and 8, the station R also comprises edge turning down folders 17, positioned close to the open end 21 of the box 6 to interfere with the passage of the edge 22 during box covering and guide the edge so that it folds towards the inside of the box and covers the open edge of the box.

Covering of the open end 21 is then preferably completed by a pair of pressure rollers 13 belonging to the station R, positioned straddling the end 21 to press the edge 22 against the wall 1 during box rotation.

It must be emphasised that the layout of the drive units and the guides described is by way of example, but its shall be understood that different mechanisms and mechanical solutions may be used to rotate the spindle 19 and perform the covering and edge turning down steps.

For example, in different solutions, both box covering and edge turning down may be carried out in the same station R. In such a case, there may be only one motor positioned at the station R and having a coupling with which the motor, for example by means of axial sliding, engages with and disengages from the carrousel spindle.

In a different solution there may be several motors, if necessary with hook-release coupling, positioned at several operating stations R, S of the carrousel set up to perform separate covering or edge turning down steps.

Once covering and edge turning down are complete, the finished box is moved by the carrousel away from the station R and to a subsequent unloading station S, then sent on for subsequent processing or storage.

Figure 10:
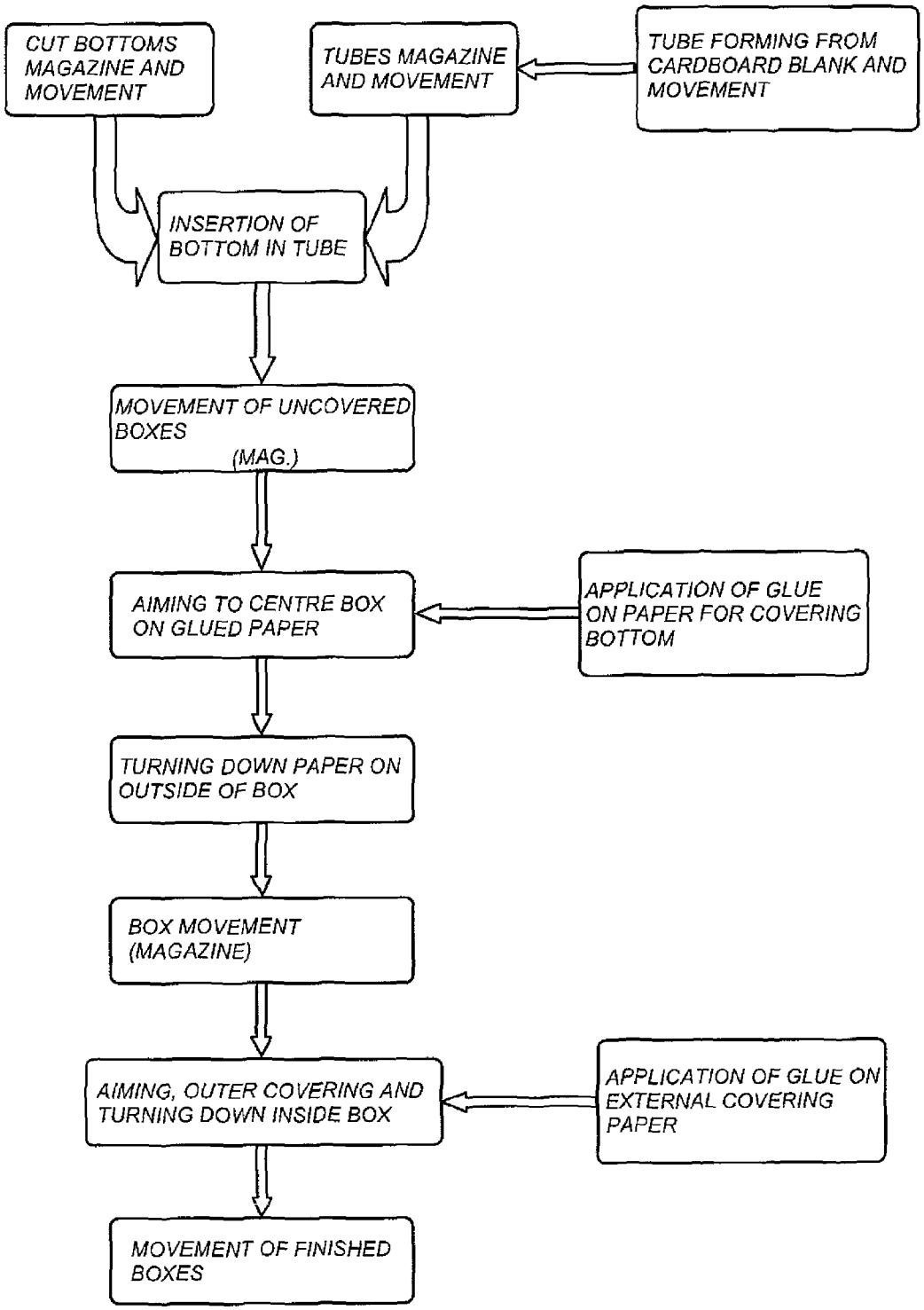
FIG. 10 shows an example of a succession of processing steps of the method in accordance with the invention.

FIGS. 10 and 11 illustrate, by way of example, a sequence of the steps described above for the automatic production of covered boxes disclosed, involving:

use of magazines for the bottoms 2 and cylindrical walls or tubes 1, assembly of the bottom and the wall to form the box 6, movement of the box 6 to the aiming station P with a pre-glued sheet 7, sheet 7 edge turning down on the wall 1, movement of the box with the bottom covered towards the station for box lateral covering with a pre-glued sheet, turning down the lateral covering sheet on the open edge of the wall, unloading with movement of the covered box.

Figure 17:
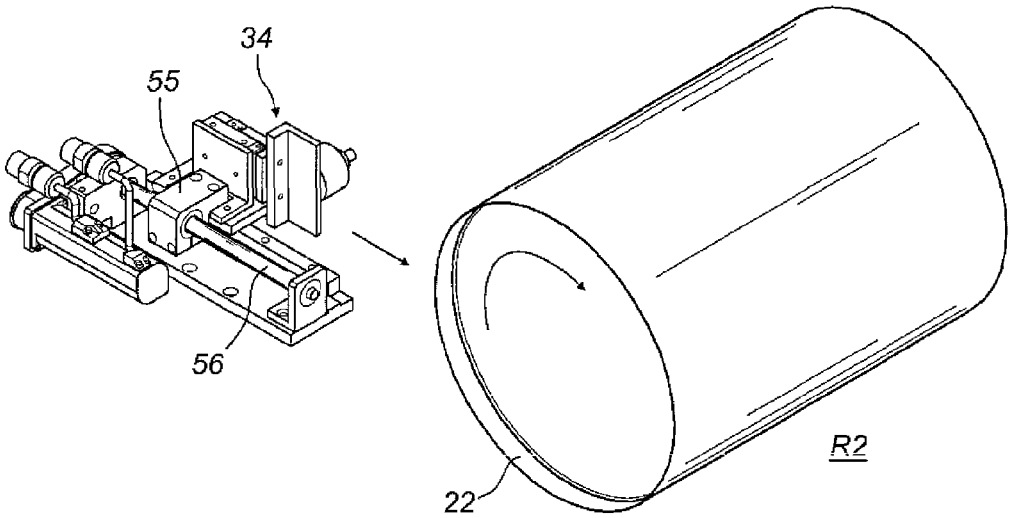
FIG. 17 shows a detail of a folding over device in a station for box lateral covering.
Figure 18:
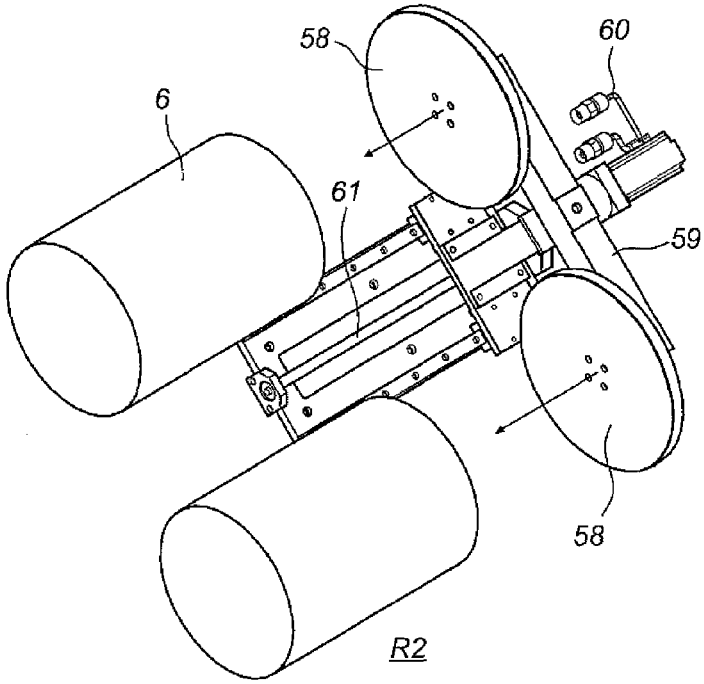
FIG. 18 shows a detail of a pair of tailstocks in a box covering station.
Figure 19:
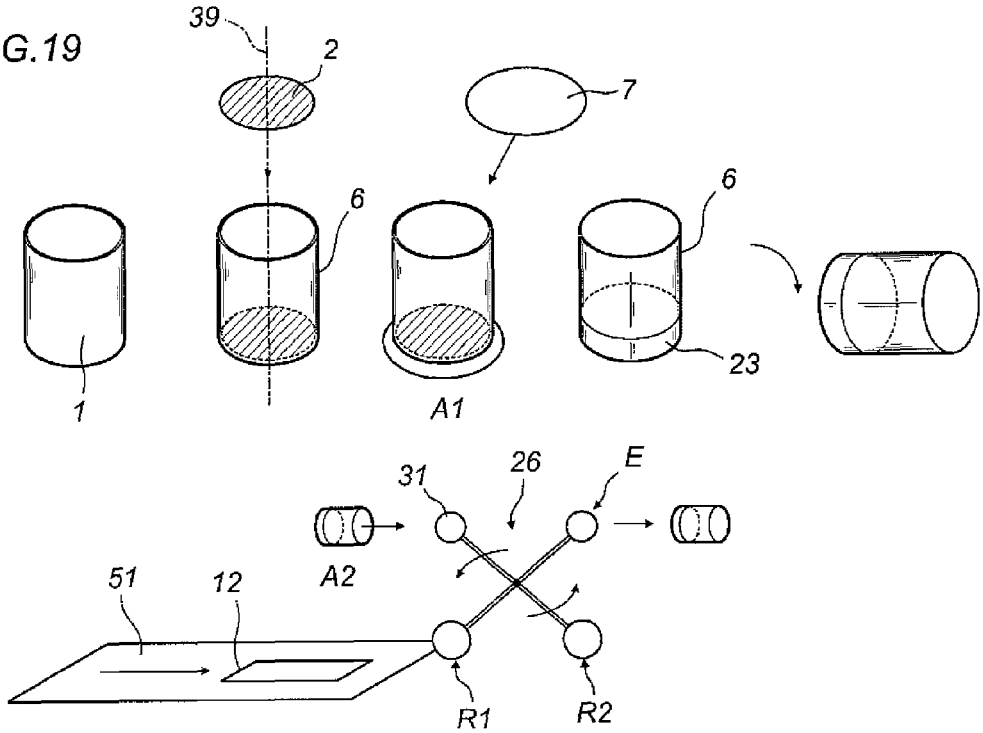
FIG. 19 is a schematic illustration of operation of a machine in accordance with the invention.

FIG. 19 is a schematic illustration of operation of a machine in accordance with the invention in a preferred embodiment illustrated in particular in FIGS. 12 to 19.

Figure 12:
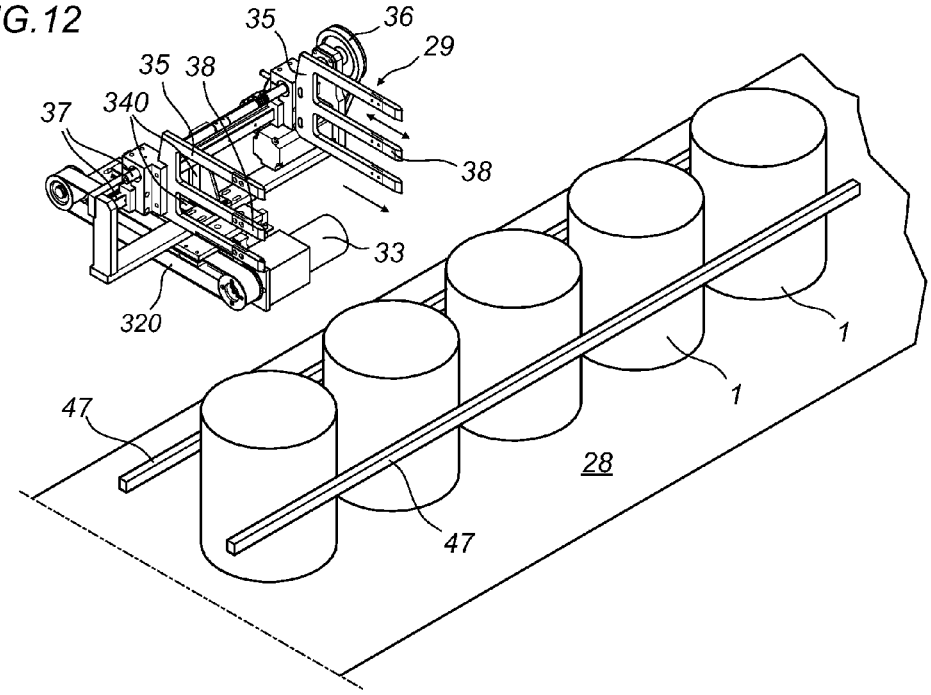
FIG. 12 shows a detail of a device for centring an open tube along a feed line.

According to the diagram in FIG. 19 and with reference to FIGS. 12 and 13, a succession of tubes 1 is fed along a belt 28 along which a fork 29 operates, centring the open tubes relative to insertion of the bottoms 2, which occurs as described with reference to FIG. 1.

In more detail, the fork 29 is driven with a backward and forward movement away from and towards the line by feed means 320, for example comprising belts 320 connected to the fork 29 and driven by a motor 33.

The fork 29 preferably comprises two arms 35 slidably mounted on respective guides 37 and able to draw near each other thanks to the action of a movement element 36, for example a belt driven by a motor (not illustrated), the front of the arms being equipped with cells 38.

During operation, the tubes 1 are guided along the line by longitudinal guides 47 passing through the openings 340 in the arms 35 and the fork 29 is repeatedly moved forward in a way that is synchronised with tube 1 feed along the line so that the cells 38 detect the position of the tube 1 held between the arms 35 being drawn near, and therefore positioned along the line in such a way that it is centred relative to the predetermined axis 39 for insertion of the bottom 2 in the tube 1 shown in FIG. 19.

Once the open tube has been assembled with the bottom 2, the boxes 6 to be covered are conveyed by the belt 28 towards the belt 30 for feeding sheets of paper 7 for covering the bottom which are applied to the boxes 6 as described with reference to FIGS. 2 to 4.

Figure 13:
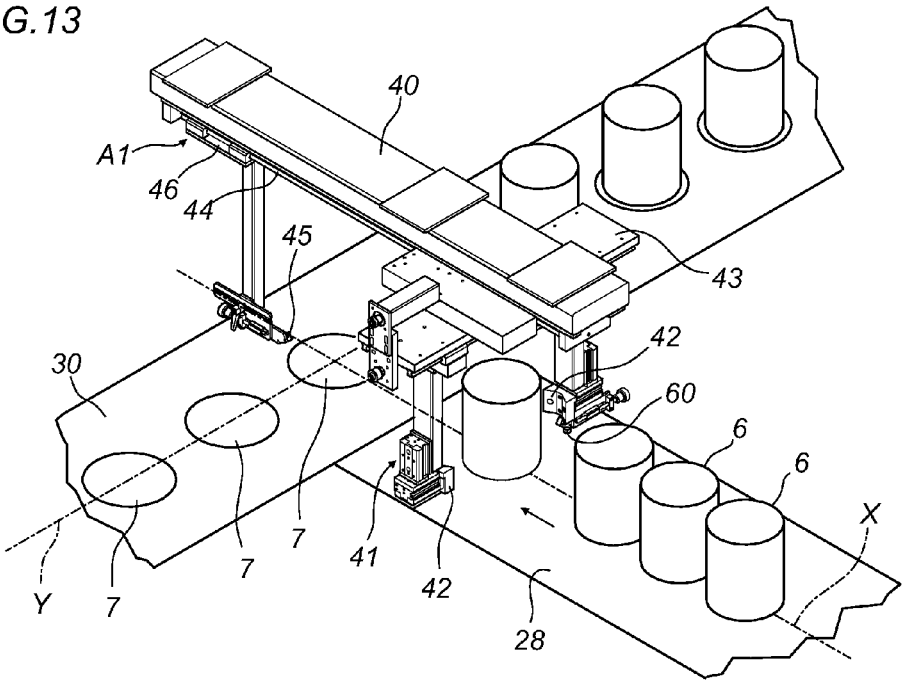
FIG. 13 shows a detail of a device for searching for and aligning along a feed line a glued disk for covering the bottom of the box.

Advantageously, along the belt 30 there is a device A1 for centring the bottom covering sheets 7 relative to the boxes 6, illustrated in FIG. 13.

The device A1 comprises a bridge 40 transversal to the belt 30 conveying the bottom covering sheets 7 and along which a box 6 gripper mechanism 41 can slide, the mechanism comprising a pair of jaws 42 supported by a transversal member 43 and able to slide along it on command. The transversal member 43 can in turn slide on command along the bridge 40 along suitable guides 44. An optical sensor 60 is applied at least at one of the gripper jaws 42.

The device A1 also comprises a sensor 45 located above the belt 30 near to the bottom covering sheet 7 transit line and supported cantilever style by a carriage 46 able to slide along the bridge 40 guides 44.

In operation, the boxes 6 arrive at the device A1 which grips them with the jaws 42 and conveys them over the belt 30 by movement of the transversal member 43 along the bridge 40.

The extent of the movement by the transversal member 43, and therefore the precise centring of the boxes 6 relative to the bottom covering sheet 7 is guaranteed by the reading of the sensor 45 which identifies the position of the bottom covering sheets 7 on the belt 30 in direction Y and transmits it to the control unit which controls the motion of the transversal member.

Moreover, once the box 6 is centred relative to Y, the sensor 60 issues the command to stop the belt 30, thus centring the box 6 and the bottom covering sheet 7 relative to the axis X.

The sensors 45 are preferably optical and detect the transit of the maximum dimension of the bottom covering sheet 7 and therefore the position of its centre on the belt relative to the axis Y.

Once the bottom covering sheet 7 has been applied, the boxes 6 are sent to the covering station F shown in FIG. 9 for completion of the covering of the bottom of the box and lateral turning down of the edge 23 of the bottom covering sheet 7.

When that has been done, the boxes 6 are tilted into a horizontal position and placed on a spindle 31 belonging to the carrousel 26 standing by at a first station S.

The mechanism for box 6 tilting and placing on the spindle 31 is not illustrated, since it is not part of the present invention.

Figure 14:
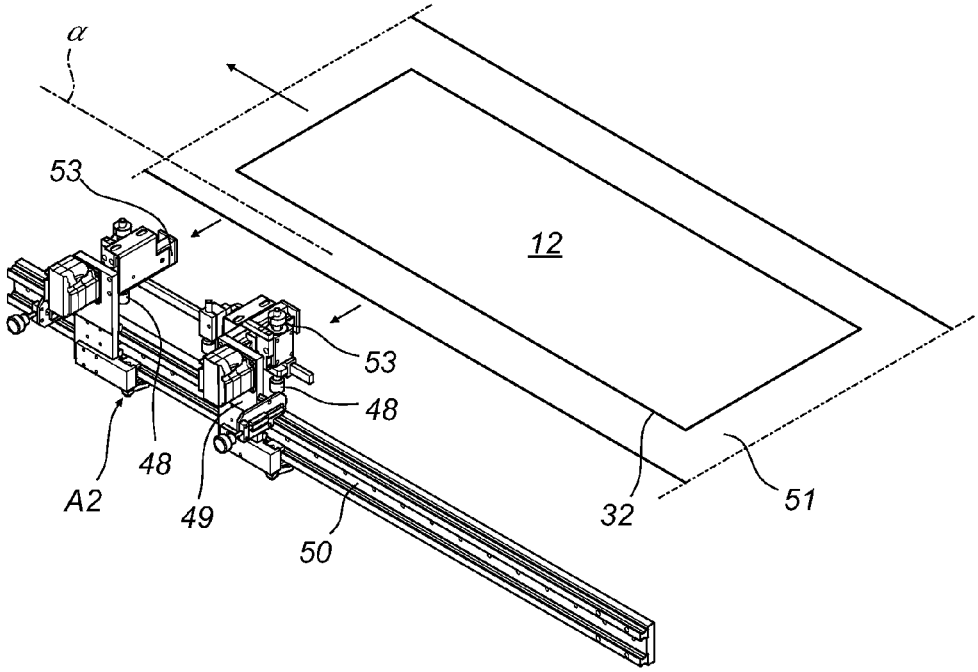
FIG. 14 shows a detail of a device for aligning along a feed line a sheet which will form the box lateral covering.
Figure 15:
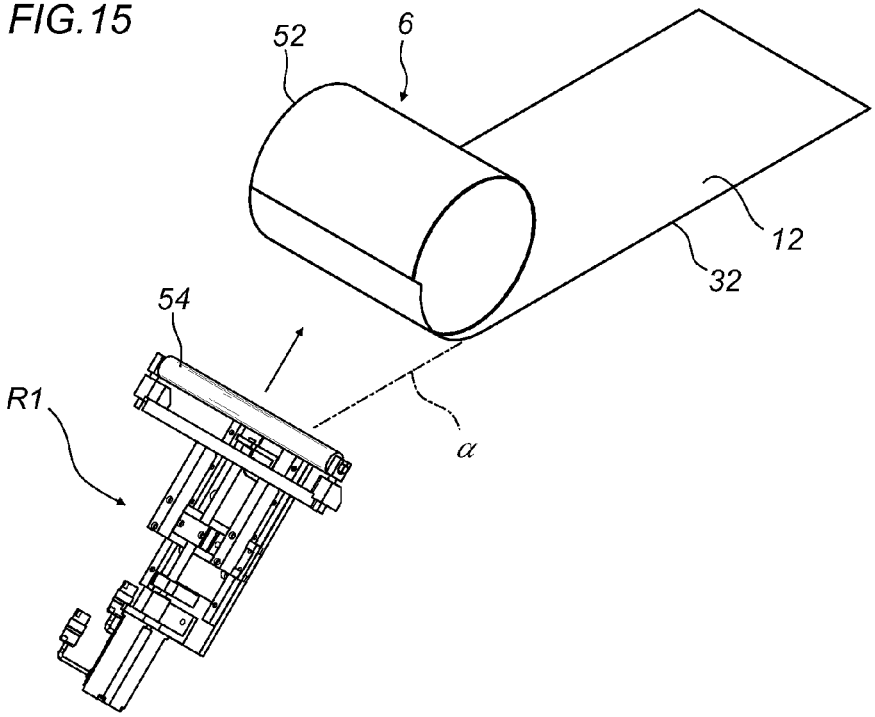
FIG. 15 shows a detail of a device for box lateral covering.

During the subsequent step, with reference to FIGS. 14 and 15 the carrousel rotates and brings the spindle to the covering station R, and in particular the first sub-station R1 located at the lateral covering sheet 12 arrival plane.

Advantageously, along the sheet 12 feed plane there is a device A2 for aligning the sheet 12 position and direction of feed relative to the box 6 mounted on the carrousel 26 spindle. In particular, the device A2 comprises one or more sensors 53 able to detect the position of a longitudinal edge 32 of the sheet 12 on the feed belt 51, and a pair of suction cups 48 (or mechanical gripper systems such as grippers and the like) able to move on command transversally to a predetermined direction "d" of sheet 12 alignment. The suction cups 48 may be mounted on carriages 49 sliding on guides 50 parallel with the longitudinal edge 32.

In operation, the direction "d" is defined in such a way that it is incident to the edge 52 of the box 6 mounted on the spindle 31.

As the sheet 12 is fed forwards, the sensors 53 detect the position of the edge 32 relative to the direction "d" so that the suction cups 48 can grip the sheet 12 and pull it transversally until the edge 32 coincides with the direction "d".

Once the alignment has been found, box 6 lateral covering in the station R1 can take place precisely, preferably with the aid of a pressure element 54 that can be drawn near the box 6 to make the sheet 12 adhere to the outer walls of the box.

Also with reference to FIG. 19, once the lateral covering has been applied, another rotation of the carrousel 26 brings the box 6 to a second covering sub-station R2, better described with reference to FIGS. 17 and 18 and in which there is advantageously a folding over device 34 for completing box 6 lateral covering.

In operation, the spindle 31 rotates the box 6 to which the lateral covering has already been applied, and the folding over device 34 is moved forwards, for example by means of a carriage 55 able to move on a guide 56, until it interferes with the excess edge 22, forcing it to fold towards the inside.

Figure 16:
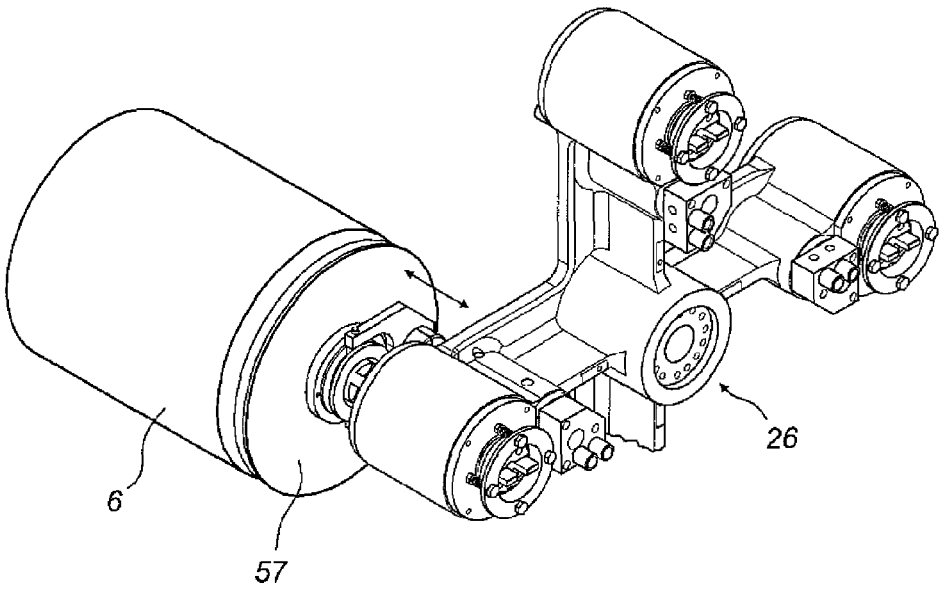
FIG. 16 shows a detail of a station for box lateral covering.

Once edge 22 folding is complete, it can be folded over the inside of the box by means of a counter-mould 57 shown in FIG. 16, able to move relative to the spindle 31 and able to be precisely inserted in the box to make the edge 22 adhere to the inner wall and cover the open end 21.

Once folding over is complete, the carrousel 26 performs another rotation, bringing the covered box to an ejection station E, from which the boxes are sent for storage or for further processing.

At the covering station R1 and the folding over station R2 there are preferably disks or tailstocks 58, schematically illustrated in FIG. 18, which during operation can draw near and make contact with the boxes 6 being processed to guarantee regular covering and folding over during rotation of the spindles 31.

Similarly, in place of at least one of the tailstocks 58 there may be contact elements designed to keep the edges of the box mounted on the spindle in the correct reference position.

The invention described above is susceptible of industrial application and may be modified and adapted in several ways without thereby departing from the scope of the inventive concept. Moreover, all details of the invention may be substituted by technically equivalent elements.

The invention claimed is:

1. An automatic machine for making curvilinear tubes or boxes covered with paper or cardboard and having a curvilinear outline, having a conveyor for conveying to a covering station a tube or a box having a first and a second end, wherein the covering station comprises:

a first sub-station equipped with a spindle, able to engage in the tube or the box and cause it to rotate relative to a horizontal axis, and operating in conjunction with a feeder for linear feed of a pre-glued covering sheet, so as to connect the covering sheet to an outer wall of the tube or the box;

a second, folding over sub-station equipped with a folding over device operated on command for covering the second, open end of the box with an excess edge of the covering sheet projecting from said second end, wherein the folding over device comprises a contact element connected to a carrier to be movable radially with respect to the tube or box engaged by the spindle, from a first position, at a distance from the tube or box, and a second position, wherein the contact element, in the second position, interferes with said excess edge of the covering sheet while the spindle rotates the tube or box about its axis.

2. The machine according to claim 1, comprising:

means for forming a curvilinear box having a bottom, stably joined to a first end of a tube with a curvilinear outline, and means for applying a pre-glued disk to the bottom to close the first end of the outer wall.

3. The machine according to claim 2, wherein the means for inserting the bottom in the outer wall comprise a first gripper element for holding and conveying the bottom.

4. The machine according to claim 2, wherein the means for applying the pre-glued covering disk comprise:

a disk supporting surface, having an opening whose shape and dimensions match the outer outline of the box, a second gripper element able to move relative to the disk supporting surface, to hold and move the box, a contact surface able to move relative to the supporting surface, which can be inserted through the opening and is opposite the element relative to the opening, means for moving the contact surface until it is drawn near the disk resting on the supporting surface, means for moving the second gripper element until the box is placed on top of a pre-glued side of the disk resting on the supporting surface and forcing the box through the opening so as to apply a peripheral portion of the disk to a stretch of the wall adjacent to the first end.

5. The machine according to claim 4, wherein the contact surface is supported by elastic means.

6. The machine according to claim 4, wherein the contact surface has a shape and dimensions which allow it to be superimposed to the end of the wall.

7. The machine according to claim 1, wherein the station is an operating station of a rotary carrousel equipped with a plurality of operating stations.

8. The machine according to claim 7, wherein the station spindle is mounted at one end of a carrousel arm and can rotate relative to an axis of rotation.

9. The machine according to claim 1, wherein the means for covering a second, open end of the box comprise a curved element in a fixed position relative to a box covering motion, the position being such that it interferes with the edge of the pre-glued sheet in such a way as to fold the edge into the box and so cover the inner stretch of the wall adjacent to the open end.

10. The machine according to claim 1, wherein the means for covering a second, open end of the box comprise pressure rollers configured to press the folded edge onto the wall.

11. The machine according to claim 1, wherein the means for forming a curvilinear box comprise means for feeding a succession of open tubes and means for centering the individual tubes relative to a predetermined position for insertion of a bottom in a positioned tube.

12. The machine according to claim 1, wherein the means for applying an adhesive disk comprise means for feeding a succession of adhesive disks and means for placing and centering a box over one of the disks.

13. The machine according to claim 1, wherein the covering means comprise a belt for feeding a succession of covering sheets and means for aligning the direction of sheet feed relative to a predetermined direction.

14. The machine according to claim 1, wherein the means for covering a second, open end of the box with an edge of the sheet comprise a counter-mould.

15. The machine according to claim 1, comprising at least one disk or tailstock which can be drawn near and into contact with the boxes at the covering stations and/or at the folding over stations.

* * * * *